US005090996A

United States Patent [19]

Cameron

[11] Patent Number: 5,090,996

[45] Date of Patent: Feb. 25, 1992

[54] MAGNESIUM PRODUCTION

[75] Inventor: Andrew M. Cameron, Chester, United Kingdom

[73] Assignee: University of Manchester Institute of Science and Technology, Manchester, United Kingdom

[21] Appl. No.: 460,167

[22] PCT Filed: Jul. 11, 1988

[86] PCT No.: PCT/GB88/00560

§ 371 Date: Jan. 9, 1990

§ 102(e) Date: Jan. 9, 1990

[87] PCT Pub. No.: WO89/00613

PCT Pub. Date: Jan. 26, 1989

[30] Foreign Application Priority Data

Jul. 10, 1987 [GB] United Kingdom ..... 8716319

[51] Int. Cl.[5] ..... C22B 4/00

[52] U.S. Cl. ..... 75/10.19; 75/10.33; 75/597

[58] Field of Search ..... 75/10.33, 10.19, 597

[56] References Cited

U.S. PATENT DOCUMENTS

| | | | |
|---|---|---|---|
| 2,380,449 | 7/1945 | Kirk | 75/598 |
| 3,681,053 | 8/1972 | Avery | 75/597 |
| 4,033,758 | 7/1977 | Johnston et al. | 75/10.33 |
| 4,572,736 | 2/1986 | Warren et al. | 75/10.33 |
| 4,699,653 | 10/1987 | Barcza et al. | 75/10.19 |

*Primary Examiner*—Melvyn J. Andrews

*Attorney, Agent, or Firm*—Spensley Horn Jubas & Lubitz

[57] ABSTRACT

Magnesium is produced by the metallothermic reduction of MgO in a molten slag bath comprised of MgO, $Al_2O_3$ and CaO together with oxide formed from the reducing metal. The composition of the slag is controlled during at least a first stage of the reduction so that it is wholly within the periclased region of its phase diagram and at least in the surface region, has a substantially constant liquidus temperature. The surface region of the slag is maintained by direct heating (e.g. by a plasma) at or close to the liquidus temperature.

15 Claims, 6 Drawing Sheets

MAGNESIUM PRODUCTION

The present invention relates to magnesium production.

Magnesium is produced industrially by both electrolytic and pyrometallurgical techniques with the former accounting for the bulk of magnesium production. So far as the pyrometallurgical techniques are concerned these may be subdivided into carbothermic and metallothermic reduction techniques. The metallothermic technique, with which the present invention is concerned, involves the reduction of MgO by a metal (which term is used herein to include silicon). For economic reasons, the reducing metal is usually silicon (provided in the form of ferrosilicon) although it is possible to use aluminium, calcium or their alloys as reducing metal.

The Magnetherm process involving the silicothermic reduction of MgO accounts for about 20% of current world magnesium production, the other 80% being produced by electrolytic techniques. More specifically, the Magnetherm process involves the silicothermic reduction of MgO in the form of calcined dolomite (dolomite $MgCO_3$ $CaCO_3$) from a molten slag bath according to the overall equation.

$$2CaOMgO+(xFe)Si+nAl_2O_3 \rightarrow 2CaOSiO_2 \cdot nAl_2O_3+2Mg+xFe$$

The process does however suffer from a number of disadvantages, as set out in the following description.

The reaction is promoted by the low silica activity in the resultant slag and by operation under a vacuum of 0.05 atm. The slag composition is held at or close to 55% CaO, 25% $SiO_2$, 14% $Al_2O_3$ and 6% MgO (all % by weight) and reaction takes place at 1550° C.

Careful control of slag composition is essential. At the operating temperature of 1550° C. the Magnetherm slag system is not fully molten and contains 40% solids as dicalcium silicate ($2CaO.SiO_2$), (Christini, R.A. "Equilibria Among Metal, Slag, and Gas Phases in the Magnetherm Process" Light Metals, New York, 1980, pp 981–995.) Successful operation of the process relies on the fact that the remaining fully liquid component has a composition situated on the boundary of the dicalcium silicate and periclase (MgO) phase fields of the quaternary $CaO$-$Al_2O_3$-$SiO_2$-MgO system. Hence the liquid component is saturated with respect to MgO 9.e. it has a thermodynamic activity of MgO which is or is close to unity.

A primary objective of the process is therefore the maintenance of a near constant slag composition. The use of dolomite (containing Ca0) enables the $CaO:SiO_2$ ratio of the slag to be kept close to 2 as $SiO_2$ is generated from the reduction reaction. Regular additions of $Al_2O_3$ are also required to keep the composition of the liquid slag component on the periclase phase boundary. Published data (Faure, C and Marchal, J "Magnesium By the Magnetherm Process" Journal of Metals, Sept. 1964, pp 721–723), suggest that Ferrosilicon and bauxite are added in roughly equal amounts by weight.

At present the process is conducted in an ac arc furnace with an upper (water cooled) copper electrode. The second electrode is formed by the carbon hearth of the furnace. Heat is generated within the molten slag and has to be transferred to the slag surface (at which the reduction occurs, by convection. At the surface the energy is consumed by the endothermic reduction reaction and in heating the raw materials (including slag additives) to the reaction temperature.

Initially the ferrosilicon droplets will be supported at the slag surface by the combined forces exerted by gas (Mg) evolution, convection within the slag bath and interfacial tension. However as Si is consumed the density difference between slag and FeSi will begin to predominate and as the metal sinks through the slag the continued reaction between FeSi and dissolved MgO becomes thermodynamically less favourable due to the increased pressure exerted by the slag.

The overall reaction can be represented by $$2(MgO)+Si \rightarrow (SiO_2)+2Mg_{(g)}$$

( ) - Species dissolved in slag.

X - Species dissolved in metal.

The free energy change for this reaction must be negative for reaction to proceed in the desired direction, and is given by $$\Delta \quad = \Delta \quad + RTlrk$$

At 1550° C.

$$\Delta \quad = 127{,}630 + RTln\left(\frac{(P_{mg})^2\, a_{SiO2}}{a_{Si}\, a^2_{MgO}}\right)$$

for the fixed and controlled composition of the Magnetherm slag system $$a_{SiO2}=0.001$$

$$a_{MgO}=1$$

The process is operated at 0.05 atms. hence it may be shown that the equilibrium silicon activity (AG=O) is 0.011.

From basic data on Fe-Si binary system, (Chart, TG "A Critical Assessment of the Thermodynamic Properties of the system Iron-Silicon" High Temperature High Pressures 1970 Vol 2 pp 461–470)

$$a_{Si}=0.011 \text{ when } X_{Si}\ 0.26$$

$$X_{Si}=0.26 = 15\%\ S_i$$

Hence under prevailing conditions of Magnetherm we would expect 15% Si in residual ferrosilicon after reaction to equilibrium. Plant data reveals 20% Si in residue. Errors arising in the calculation will be due to inaccuracies with respect to basic thermodynamic data, particularly slag activities which are estimated taken from Magnetherm publications (Christini, R.A. loc cit). Nevertheless it is not unreasonable to speculate that equilibrium is not being achieved.

Returning to question of pressure at which the process is operated the equilibrium constant K is $$K = \frac{(P_{Mg})^2\, a_{(SiO2)}}{a_{Si}\, a^2_{(MgO)}}$$

For a constant slag composition and temperature $a(SiO_2)$ and $a(MgO)^2$ are fixed. Consequently any attempt to go to high pressure operation will lead to an increase in $a_{Si}$. The efficiency with which the Si is utilised would therefore be reduced.

The need to operate at low pressure in order to effectively use the Si is a major disadvantage of the process. At the elevated temps. involved maintenance of a vacuum of 0.05 atms. is technically difficult. Ingress of air to the system is reported (Flemings, M.C. et al loc cit) to result in loss of about 20% of the produced magnesium. The vacuum requirement also renders the process a batch process and a daily down-time of 12–15% is required to tap the furnace, recover condensed magnesium and remove MgO and $Mg_3N_2$ from the condensor system.

Many of these problems could be eliminated by operation at higher temperatures. In the existing version of the Magnetherm process the attainment of higher temperatures and so higher magnesium pressures is prevented by the onset of carbothermic reduction of the slags MgO by carbon. This carbon is present in the reactor lining and electrode as well as being present as dissolved carbon in the ferrosilicon. At a total pressure of 1 atms. the reaction $$(MgO)+C=Mg_{(g)}+CO_{(g)}$$

reverses unless the gas temperature is kept above 1780° C. Hence any CO produced as a side reaction will result in reoxidation of part of the $Mg_{(g)}$ product.

FR-A2590593 (Council for Mineral Technology) describes an improvement in the Magnetherm process wherein the surface of the reaction zone is heated directly by means of a transferred-arc thermal plamsma. The preferred temperature of the reaction zone is stated to be 1950K (1677° C.) and the feedstocks specifically disclosed are standard Magnetherm process feedstocks such that the slag compositions for the process of this French specification and the original Magnetherm process are directly comparable. However at the higher processing temperatures disclosed in FR-A-2590593 the liquid component of the slag will no longer have composition located on the dicalcium silicate phase boundary, and will in fact have a composition in the dicalcium silicate region of the phase diagram. The activity of MgO will therefore be less than unity which will result in poor utilisation of silicon reductant since from the equation given above for the equilibrium constant K, decrease of $a_{MgO}$ below unity means that $a_{Si}$ must increase for any given slag composition and temperature.

There is a suggestion in FR-A-2590593 that the $Al_2O_3$ addition can be reduced or eliminated but this is not believed to be practical since it is required by the Magnetherm process in order to retain a high $a_{MgO}$ and not as a modification to electrical resistivity and viscosity as suggested in FR-A-2590593.

It is an object of the present invention to obviate or mitigate the abovementioned disadvantages.

According to the present invention there is provided a method of producing magnesium by the metallothermic reduction of MgO in which the reaction is effected in a molten slag bath comprised of MgO, $Al_2O_3$ and CaO together with oxide formed from the reducing metal, adding reducing metal and MgO or MgO containing feed material to the bath, and directly heating the surface of the molten slag characterised in that at least during a first stage of the reduction the molten slag has a composition wholly within the periclase region of its phase diagram with a substantially constant liquidus temperature at least in the surface region, and at least the surface region of the slag is maintained by the direct heating at or close to the liquidus temperature.

Preferably the feed material is provided at least partly by calcined dolomite. Preferably also the reducing metal is silicon (provided for example as ferrosilicon). Calcium aluminium or their alloys may also be used as reducing metal but are less preferred on economic grounds.

Thus, during at least a first part of the reduction process, the following conditions are satisfied.

(i) the molten slag has a composition wholly within the periclase region of its phase diagram;

(ii) composition of the slag is controlled so as to have a substantially constant liquidus temperature (preferably 1700°–2100° C., more preferably 1800°–2000° C., most preferably 1900°–1950° C.); and (iii) at least the surface region of the slag is maintained at the liquidus temperature.

The reference to the periclase region of the phase diagram means that molten phase from which the first solid to deposit on cooling is MgO.

The liquidus temperature is that temperature at which solid (in the case MgO) would first begin to appear upon cooling of the molten slag. In the first stage of the reduction reaction the slag composition may vary as the extraction progresses but this variation is controlled such that the slag has a composition within the periclase region of its phase diagram and has a substantially constant liquidus temperature. The direct heating of the surface region of the slag, which is where the reduction takes place, is maintained as close as possible to the liquidus temperature. This ensures that the activity of MgO (i.e. $a_{mgo}$) in this surface region is at or close to unity throughout the first stage of the reaction and thus the surface region is saturated with MgO. The value of 1 for $a_{mgo}$ allows optimum efficiency of the metal reductant. Heating the surface region substantially above the liquidus temperature means that this region is not longer saturated with MgO. The slag below the surface region will be at a temperature below the liquidus temperature due to temperature gradients within the slag bath. Such temperature gradients may in fact result in some solidification of MgO within the melt and resultant local variations in the liquidus temperature of the molten slag where it is MgO deficient. Nevertheless the surface region of the slag which will be fully molten will have the substantially constant liquidus temperature throughout the first part of the reduction. The reference to the liquidus temperature being substantially constant does not, of course, means that it must be kept exactly constant but only as constant as possible within practical limits, say 50° C. either way. Similarly, the temperature of the surface region of the slag should be maintained as close as practically possible to the liquidus temperature.

The depth of the surface region which is maintained at or close to the liquidus temperature should be as great as posible but will depend on factors such as the means used for directly heating the surface of the melt and the means used for the cooling of the furnace. For example it is anticipated that the use of air cooling allows a greater depth of surface region tó be maintained at the liquidus temperature than does the use of water cooling, all other things being equal.

The preferred, substantially constant, liquidus temperature for the surface region of the slag is 1800–2000° C., more preferably 1900–1950° C. The use of such temperatures allows the reduction to be conducted at atmospheric pressure, which is a significant advantage of the invention. Below this temperature, the thermodynamic driving force for the reaction may be too low at atmospheric pressure giving lower silicon (or other metal reductant) efficiencies whereas at temperatures above 2000° C. the process could become difficult to operate, particularly since other species may participate in the reaction. One method of achieving a substantially constant liquidus temperature is to allow the slag composition to change in such a way as to keep a near constant 'excess-base' as defined by $$\text{Excess base} = n\ MgO + n\ CaO - 2/3\ n\ Al_2O_3 - n\ .SiO_2$$

where n =number of moles of the appropriate oxide ( and may have a different value for each oxide)

This will be demonstrated by reference to the accompanying phase diagrams reproduced in FIGS. 1–6 (see later).

By contrast with the Magnetherm process operated as described previously, it is considerably easier to maintain a slag composition which lies within the bounds of the periclase region of the system (albeit with a substantially constant liquidus temperature) than one which must be maintained on the $2CaO.SiO_2$-periclase phase boundary.

Furthermore the higher liquidus temperature of slags within the periclase region (as compared to those at the $2CaO.SiO_2$-periclase phase boundary) means that a higher temperature of reaction may be used than in the aforesaid Magnetherm process, thereby favouring magnesium production.

The conditions (i)–(iii) above apply to what has been termed 'at least the first part of the reaction'. Such conditions may in fact, be maintained throughout the reaction process. It is however possible in a further embodiment of the invention to allow the first part of the reaction to proceed for a predetermined length of time and then adjust the reaction parameters such that the composition of the slag moves towards the $2CaO.SiO_2$-periclase boundary which means that a substantially constant liquidus temperature in the surface region of the slag is no longer maintained. In the 'second part' of the reaction the composition of the slag may be varied so as to move towards the $2CaO.SiO_2$ periclase phase boundary along a line of constant $CaO:Al_2O_3$ mass ratio. Such a variation may be obtained by discontinuing addition of further MgO (or MgO containing) feed material to the slag. In the limiting case, the second part of the reaction is continued until the aforesaid phase boundary is reached. As the slag composition moves towards the phase boundary, the MgO activity (aMgO) becomes less than unity unless the processing temperature is gardually decreased and the efficiency with which the metal reductant (eg Si) is used decreases. There is however an increase in Mg yield (as will be demonstrated below) which may compensate for this reduction in efficiency. Thus the extent to which the second part of the reaction is conducted (if at all) is a matter for economic considerations.

The surface of the slag is heated directly, preferably by means of a plasma or a DC-arc. The use of such heating systems readily provide the comparatively high temperatures required for effecting the reaction as well as obviating the need for a submerged carbon electrode as used in the standard Magnetherm process. The elimination of a carbon anode is necessary if operating in the preferred temperature range which is higher than that suggested in FR-A-2590593 since this will help prevent unwanted production of CO. Consequently, unwanted production of carbon monoxide (which could result in reoxidation of the magnesium) is avoided. Any CO which is produced as a result of carbonaceous impurities will be greatly diluted by the arc gases and so the extent of reaction of Mg and CO will be reduced to acceptable levels. This enables operation of the process at atmospheric pressure and so enhance yield, at least partly because the reaction will be not so sensitive to surface control at these higher pressures as compared to those used in the Magnetherm process. Downtime due to condenser maintenance will be significantly reduced and slag tapping without interruption of the production cycle will be feasible. Overall cycle times have potential to be considerably longer than in the Magnetherm process An additional advantage of plasma or D.C. arc systems in the transference of power directly to the slag surface from the gas. Additionally, the feedstocks for the reaction may be pre-heated in the plasma (or arc) which, together with the high surface temperatures, result in rapid reactions ensuring the attainment of equilibrium.

As indicated, the surface of the melt is preferably heated by a plasma or D.C. arc.

Plasma reactors in which a plasma torch is used are generally classified as transferred or non-transferred arc systems. Plasmas can also be generated using hollow graphite electrodes. Each of these systems would be suitable for the process provided there is no need for a submerged graphite electrode.

Non-transferred arc plasma torches contain both electrodes within a single unit. The torch is situated above the melt and is usually introduced to the furnace via the roof or sidewall. Gas consumption is higher than transferred arc systems. High gas flow results in a flame of partially ionized gas being blown towards the melt.

In tranferred arc systems, the anode is situated at the bottom of the furnace. The main driving force for the plasma flame is no longer gas velocity but the electrical field between the electrodes. Gas consumption is lower than N.T.A. systems. Anode is usually graphite but could be metal rods or plates positioned between refractory lining of furnace. Such a mode of operation is used in D.C. arc furnaces.

Alternatively the anode can be placed above the melt to form a ring around the furnace side walls.

Alternating current plasma torches have been demonstrated ar pilot scale. No return electrode is needed. Power levels are already appropriate to the proposed process.

Extended arc furnaces are 'psuedo' plasma furnaces. Essentially they are modified arc furnaces in which gas is blown through hollow electrodes positioned above the melt.

D.C. arc furnaces are similar to transferred arc plasma systems however the cathode consists of a hollow graphite electrode through which plasma forming gas is blown. Feedstocks can also be charged through the electrode. The return electrode consists of metal plates located between the refractory bricks at the bottom of the furnace.

The invention will be illustrated by the following Examples and with reference to the accompanying drawings in which.

In FIGS. 2–6, the $2CaO.SiO_2$-periclase phase boundary is denoted by a solid black line.

Example 1

The aim of this Example is to illustrate the production of magnesium from calcined dolomite using a slag comprised of MgO CaO, and $Al_2O_3$ with a composition in the periclase region of the phase diagram and a liquidus temperature in the surface region of the slag of about 1950° C. which is maintained throughout the reaction. The feed material for the process is assumed to be a calcined dolomite containing 47% MgO and 53% CaO. Additional MgO is also used as detailed below.

The reducing metal is silicon (provided as ferrosilicon). Heat for the reduction would be provided for example by a plasma which maintains the surface region of the slag at the liquidus temperature.

Figure 1:
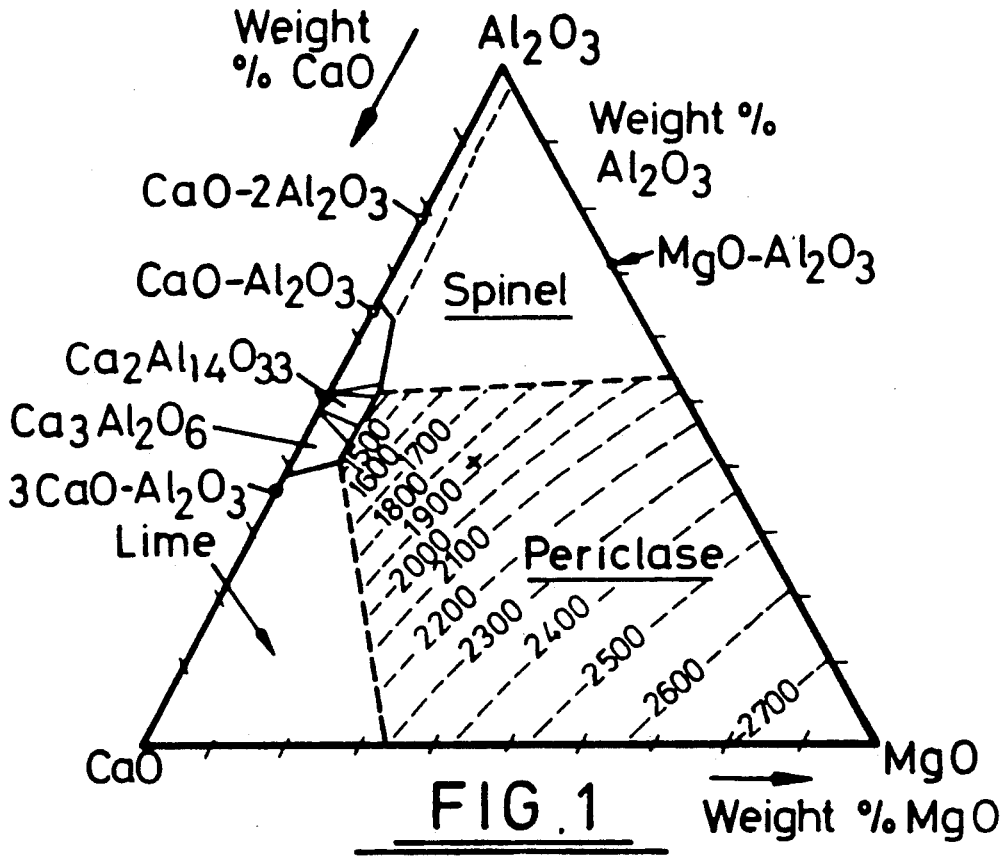
FIG. 1 shows a simplified version of the $CaO-Al_2O_3-MgO$ phase diagram.

The slag is comprised of MgO, CaO and $Al2O_3$ and has a liquidus temperature of about 1900° C. Reference to FIG. 1 ($MgO-CaO-Al_2O_3$ phase diagram) shows that such a slag may comprise 25% Mg0, 33% Ca0, and 42% $Al_2O_3$, as marked by "X" in the diagram.

A suitable slag may be easily prepared and melted in a suitable furnace, i.e. one without a carbon lining.

The overall reduction reaction can be represented by the following equation.

$$2\,(MgO)+Si\,(SiO_2)+2Mg$$

Consequently for each kg of magnesium produced 1.24 kg of $SiO_2$ will also be obtained and 1.65 kg of MgO will be consumed.

The addition of an amount of dolomite to the slag which provides 1.65 kg of MgO will introduce 1.86 kg of CaO into the melt. The simple addition of the calcined dolomite would change the liquidus temperature of the slag. As demonstrated below, the addition of a suitable amount of MgO (additional to that provided by the dolomite) may be used to maintain the liquidus temperature substantially constant.

Consider a process which starts with 200 kg of molten slag comprised of 50 kg MgO (25%), 66 kg of CaO (33% ) and 84 kg $Al_2O_3$ (42%). Assume also that for each 10 kg of Magnesium produced 35.1 kg of calcined dolomite (comprised of 16.5 kg MgO and 18.6 kg CaO) and 10 kg MgO are also added. Each 10 kg of Magnesium produced results in 12.4 kg of $SiO_2$ and the consumption of 16.5 kg of MgO.

Thus after 10 kg of magnesium have been produced the slag will comprise (after the aforementioned additions)

| | | |
|---|---|---|
| MgO = | 60 kg | (i.e. 50–16.5 + 16.5 + 10) |
| CaO = | 84.6 kg | (i.e. 66 + 18.6) |
| $Al_2O_3$ = | 84 kg | |
| $SiO_2$ = | 12.4 kg | |
| TOTAL = | 241 kg | |

Consequently, as magnesium extraction continues, the slag composition (% by weight) will vary as follows.

| Mg prod. | Slag Composition % wgt | | | | Wgt Slag | |
|---|---|---|---|---|---|---|
| (kg) | MgO | CaO | $Al_2O_3$ | $SiO_2$ | (kg) | Excess Base |
| 0 | 25 | 33 | 42 | — | 200 | 0.93 |
| 10 | 24.9 | 35.1 | 34.8 | 5.1 | 241 | 0.93 |
| 20 | 24.8 | 36.6 | 29.7 | 8.8 | 282 | 0.93 |
| 30 | 24.7 | 37.7 | 26.0 | 11.5 | 323 | 0.93 |
| 40 | 24.7 | 38.6 | 23.1 | 13.6 | 364 | 0.92 |
| 50 | 24.6 | 39.2 | 20.7 | 15.3 | 405 | 0.92 |
| 60 | 24.6 | 39.8 | 18.8 | 16.7 | 446 | 0.92 |
| 70 | 24.6 | 40.3 | 17.2 | 17.8 | 487 | 0.92 |
| 80 | 24.6 | 40.7 | 15.9 | 18.8 | 528 | 0.92 |
| 90 | 24.6 | 41.0 | 14.7 | 19.6 | 569 | 0.92 |
| 100 | 24.6 | 41.3 | 13.8 | 20.3 | 610 | 0.92 |

Figure 2:
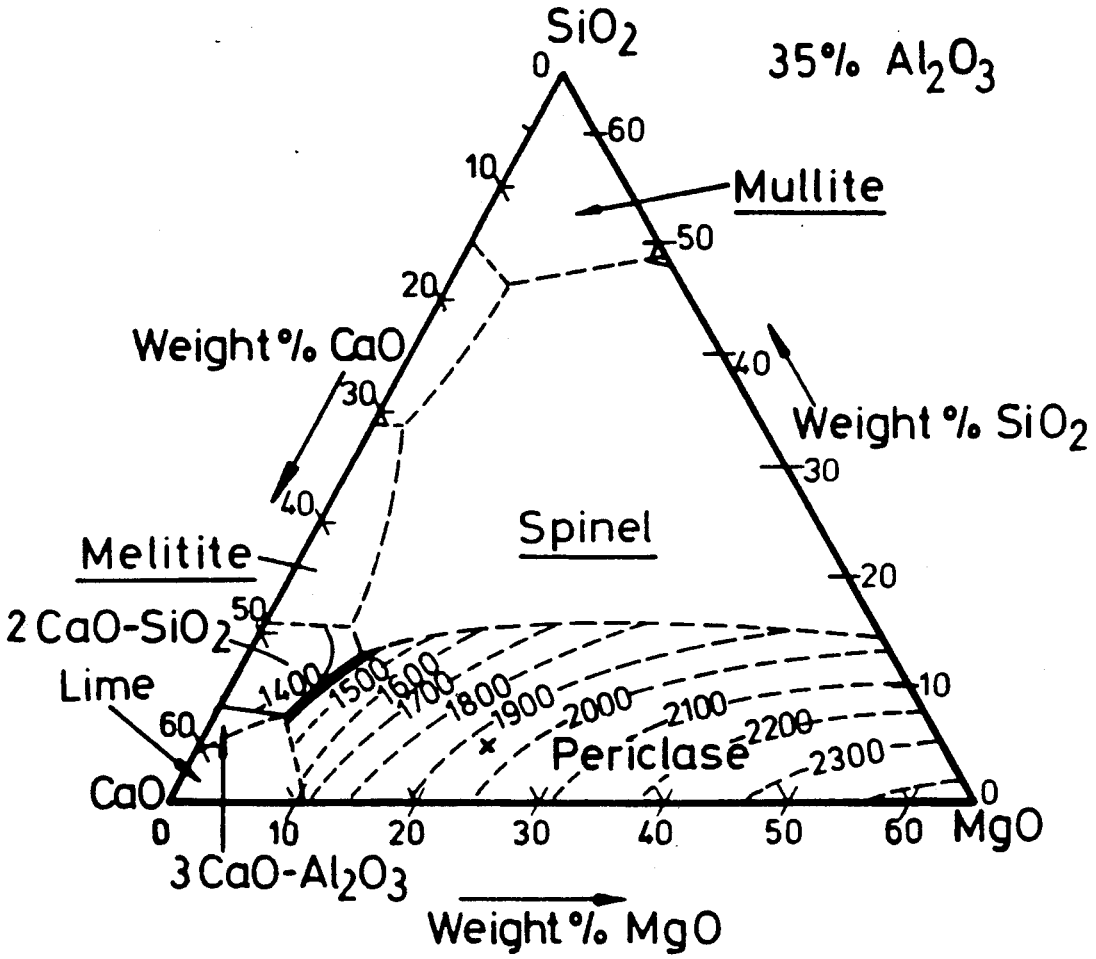
FIGS. 2–6 show simplified versions of the $CaO-Al_2O_3-SiO_2-MgO$ phase diagram at 35%, 30%, 25%, 20% and 15% levels of alumina respectively.
Figure 3:
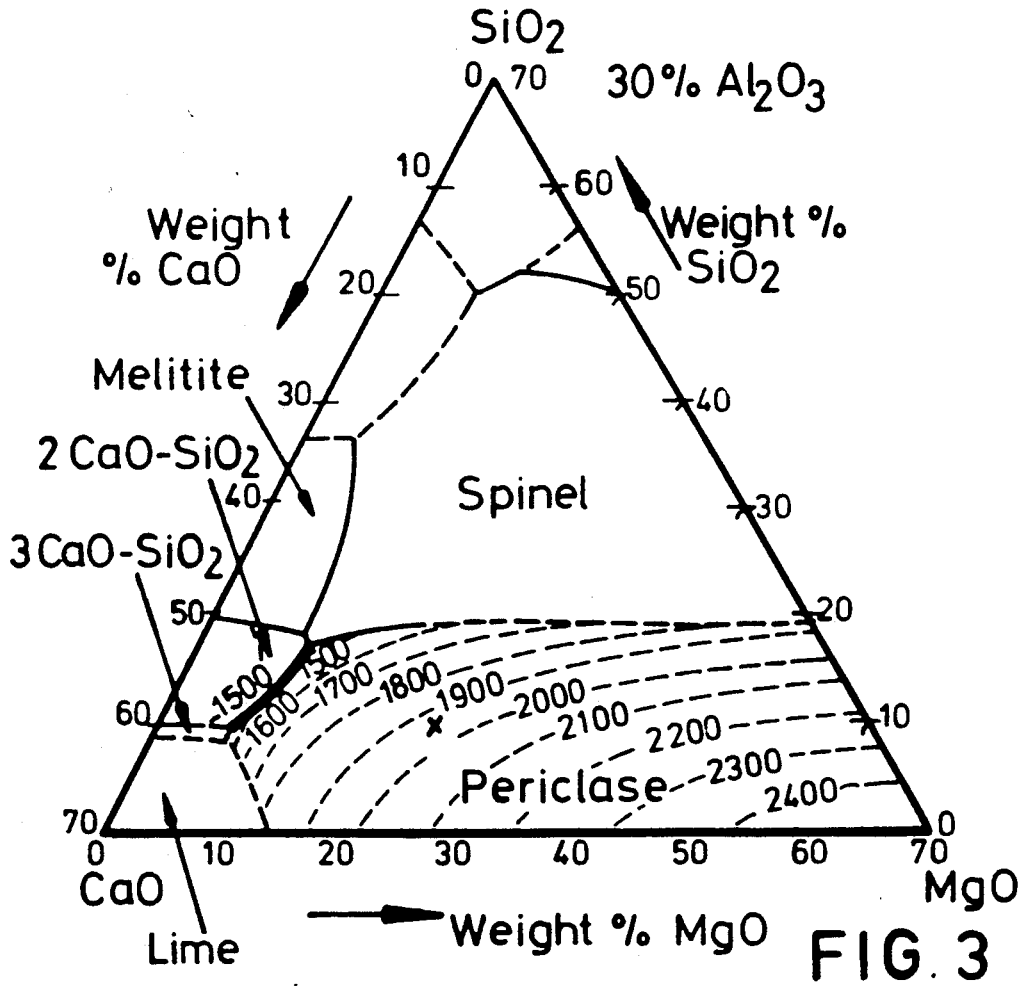
Figure 4:
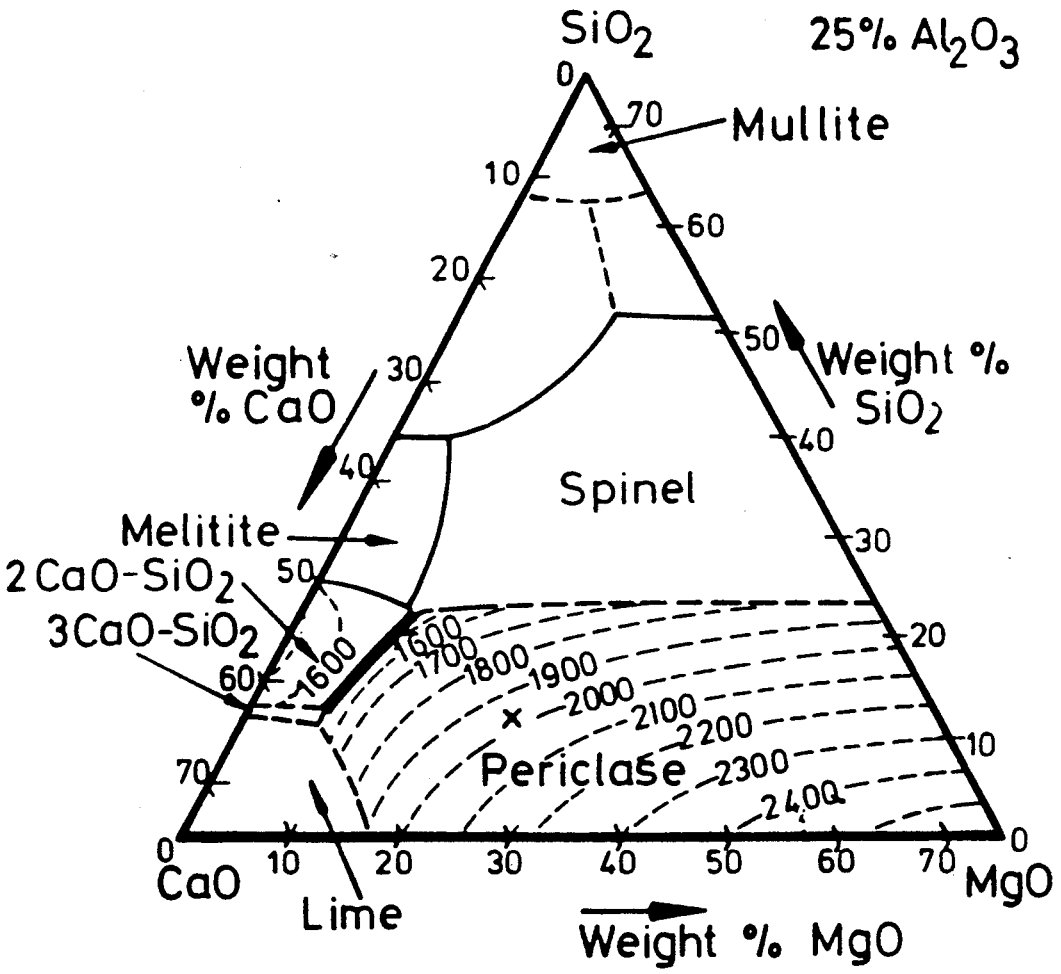
Figure 5:
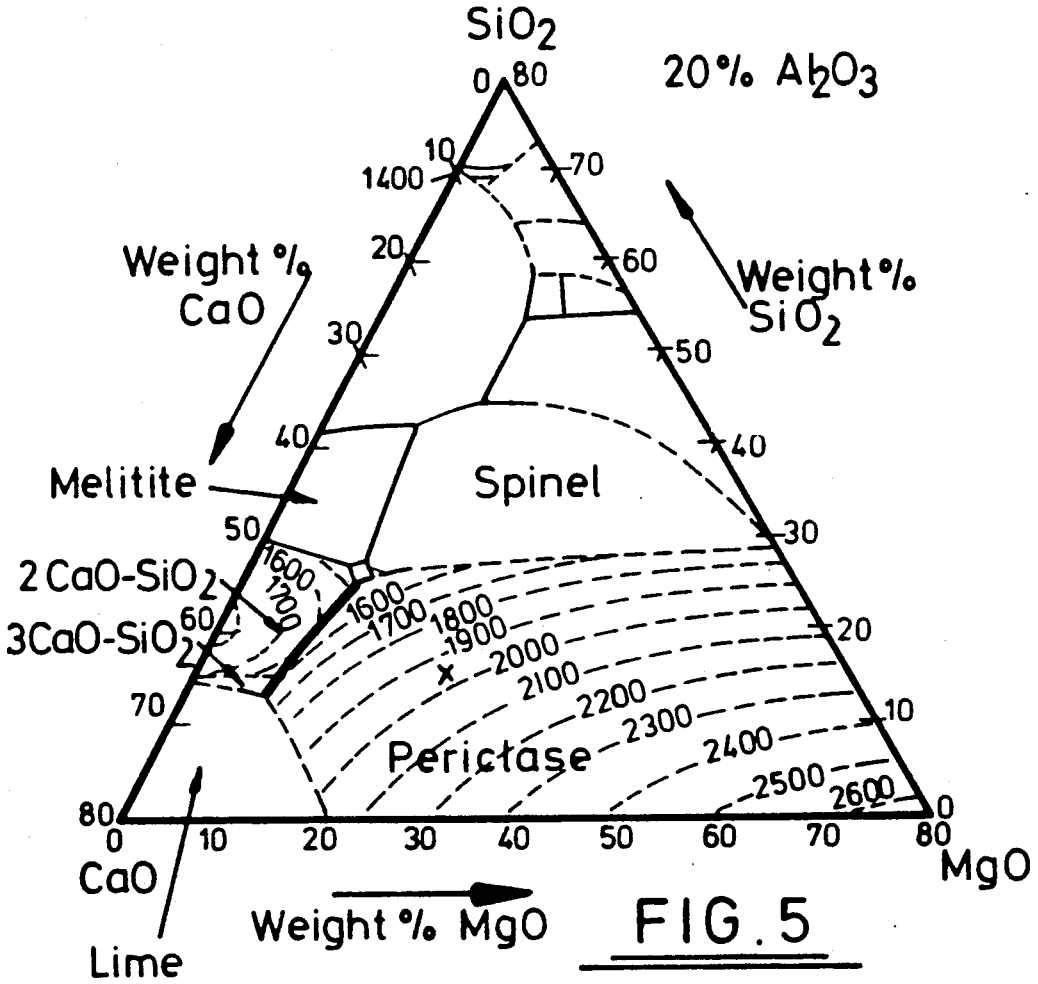
Figure 6:
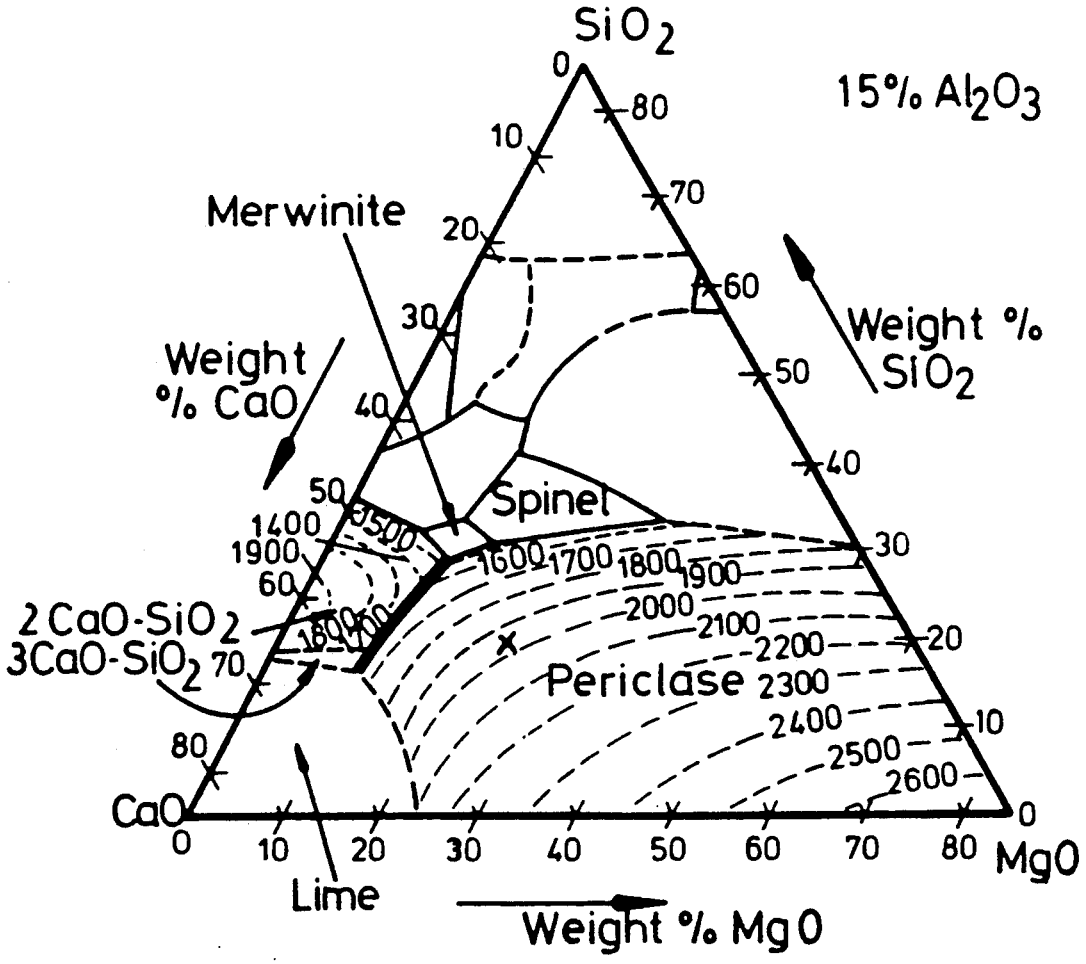

Consider now the slag composition when 10 kg of magensium have been extracted. The slag contains 24.9% MgO, 35.1% CaO, 34.8% $Al_2O_3$, and 5.1% $SiO_2$. Reference to FIG. 2 (which is the phase diagram of the $MgO-CaO-Al_2O_3-SiO_2$ system at 35% $Al_2O_3$) shows that this slag has a liquidus temperature of ca 1950° C. Similarly, the slag liquidus temperature after 20 kg, 30 kg, 50 kg and 90 kg of magnesium have been extracted may be obtained from FIGS. 3, 4, 5 and 6 respectively (these Figures being for phase diagram of $MgO-CaO-Al_2O_3-SiO_2$ system at 30%, 25%, 20% and 15% $Al_2O_3$ levels). These liquidus temperatures will all be seen to be ca 1950° C. Furthermore, all slag compositions are in the periclase region of the phase diagram.

The liquidus temperature of the slags is constant at about 1950° C. If we therefore assume that the reactions occur at the slag surface at a temperature of about 1950° C. we can take the magnesia activity to have a constant value of unity. CaO, $Al_2O_3$ activities can be estimated from published data on the constituent ternaries.

Consider the reaction $$2MgO + Si = SiO_2 + 2Mg$$

$$\Delta \quad = \Delta \quad ^{\circ} + RT\ln\frac{P^2_{mg}\,a_{SiO_2}}{a^2_{MgO}\,a_{Si}}$$

For the envisaged process conditions $P_{mg}=1$ and $a_{MgO}=1$.

The value of $aSiO_2$ will gradually increase from negligable levels to a value similar to that estimated for the Magnetherm slag of 0.001. This estimate allows aSi in the residual ferrosilicon to be calcuated for the latter stages of the process and for reaction at 2173K (1900° C.). It can be shown that $a_{si}$ (residue) can be expected to be 0.02 for the upper levels of $SiO_2$ content envisaged in the process. This is equivalent to 16 wt% Si in the residue. At earlier stages of the process the Si efficiency will be considerably higher due to the low activity of $SiO_2$ in the slag. The overall effect will be significantly reduced silicon contents in the spent ferro-silicon as compared to existing processes.

If the slag is tapped off when 100 kg of Mg have been produced some 610 kg of slag will have been processed. This is comparable to the relative amount processed in Magnetherm.

Example 2

This Example is to illustrate a process in which a substantially constant liquidus temperature is maintained in the surface region of the slag during a first stage of the reaction, and subsequently the reaction parameters are varied in a second stage of the reaction to move the slag composition towards the 2CaO $SiO_2$ periclase phase boundary.

Consider a process which starts with 205 kg of molten slag comprised of 55 kg MgO (26.8%), 66 kg CaO (32%) and 84 kg A1203 (41%). Assume in this case that magnesia and or dolomite is added such that for each 10 kg of magnesium produced we add a total of 26.5 kg MgO (47% of addition) and 29.8 kg CaO (53% of addition). Hence for each 10 kg of magnesium produced the slag bulk increases by 10 kg MgO, 12.4 kg $SiO_2$ and 29.8 kg CaO. Consequently as magnesium extraction continues, the slag composition (% by weight) will change as follows:

| Mg produced | Slag Composition (% wgt) | | | | Weight | Excess |
|---|---|---|---|---|---|---|
| (kgs) | MgO | CaO | $Al_2O_3$ | $SiO_2$ | Slag | Base |
| 0 | 26.8 | 32 | 41 | 0 | 205 | 0.97 |
| 10 | 25.3 | 37.2 | 32.6 | 4.8 | 257.2 | 1.00 |
| 20 | 24.2 | 40.6 | 27.1 | 8.0 | 309.4 | 1.01 |
| 30 | 23.5 | 42.9 | 23.2 | 10.3 | 361.6 | 1.03 |
| 40 | 22.9 | 44.7 | 20.2 | 12.0 | 413.8 | 1.03 |
| 50 | 22.5 | 46.1 | 18.0 | 13.3 | 466 | 1.04 |
| 60 | 22.2 | 47.2 | 16.2 | 14.3 | 518.2 | 1.05 |
| 70 | 21.9 | 48.1 | 14.7 | 15.2 | 570.4 | 1.05 |
| 80 | 21.7 | 48.8 | 13.5 | 15.9 | 622.6 | 1.06 |
| 90 | 21.5 | 49.5 | 12.4 | 16.5 | 674.8 | 1.06 |
| 100 | 21.3 | 50.0 | 11.5 | 17.0 | 727 | 1.06 |
| 110 | 21.2 | 50.3 | 10.7 | 17.5 | 779 | 1.06 |
| 120 | 21.0 | 50.9 | 10.1 | 17.9 | 831 | 1.06 |
| 130 | 20.9 | 51.3 | 9.5 | 18.2 | 883.6 | 1.07 |
| 140 | 20.8 | 51.6 | 8.9 | 18.5 | 935.8 | 1.07 |
| 150 | 20.7 | 51.9 | 8.5 | 18.8 | 988 | 1.07 |

In this instance a near constant liquidus temperature of approximately 1950° C. is maintained as may be determined from FIGS. 1–6. Once again the ratio of slag processed to magnesium produced is comparable to the Magnetherm process. This magnesium yield can be enhanced by adopting the following procedure. Consider the slag composition obtained after production of 150 kg Mg according to this example. If the CaO:$Al_2O_3$ mass ratio is held constant by subsequently feeding only silicon containing reductant then the slag composition will change as follows:

| Mg produced | Slag Composition (wt %) | | | | Slag Weight |
|---|---|---|---|---|---|
| (kgs) | MgO | CaO | $Al_2O_3$ | $SiO_2$ | (kgs) |
| 150 | 20.7 | 51.9 | 8.5 | 18.8 | 988 |
| 160 | 19.1 | 52.1 | 8.5 | 20.2 | 983.9 |
| 170 | 17.5 | 52.3 | 8.6 | 21.5 | 979.8 |
| 180 | 15.9 | 52.6 | 8.6 | 22.9 | 975.7 |
| 190 | 14.3 | 52.8 | 8.6 | 24.2 | 971.6 |
| 200 | 12.7 | 53.0 | 8.7 | 25.6 | 967.5 |

This would significantly increase the magnesium yield in terms of kg magnesium produced per kg slag processed. It should be noted that this step would require a gradual reduction in temperature from about 1950° C. to about 1700° C. in order to maintain favourable conditions of high magnesia activity. The penalty would be that a gradual increase in silicon content of the residual reductant would be associated with the lowerinq in temperature. Nevertheless, since the final conditions of temperature and composition are comparable with those proposed in FR-A-2590593 the overall efficiency with which the silicon is consumed would still be higher than in the alternative processes.

The desireability of this second optional stage will be dependent on the process economics. The benefit of higher magnesium yield will be counterbalanced by lower silicon utilisation and the optimum situation will probably reflect a compromise between these.

I claim:

1. A method of producing magnesium by the metallothermic reduction of MgO comprising the steps of:

effecting the reaction in a molten slag bath consisting essentially of MgO, $al_2O_3$ and CaO together with oxide formed from the reducing metal, the slag defining a surface and a phase diagram having a periclase region, adding reducing metal and MgO or MgO containing feed material to the bath, directly heating the surface of the molten slag, controlling the composition of the molten slag so that the composition is wholly within the periclase region of the phase diagram with a substantially constant liquidus temperature at least in the surface region, and maintaining at least the surface region of the slag by the direct heating at a temperature substantially equal to the liquidus temperature.

2. A method as claimed in claim 1 wherein the reducing metal comprises silicon.

3. A method as claimed in claim 2 wherein the silicon is added to the molten slag as ferro-silicon.

4. A method as claimed in claim 1 comprising the step of adding calcined dolomite as feed material containing MgO.

5. A method as claimed in claim 4 comprising the step of adding magnesium oxide.

6. A method as claimed in claim 1 wherein the substantially constant liquidus temperature is in the range 1800° to 2000° C.

7. A method as claimed in claim 6 wherein the substantially constant liquidus temperature is in the range 1900° to 1950° C.

8. A method as claimed in claim 1 wherein the phase diagram defines a 2CaO.$SiO_2$-periclase phase boundary, comprising the step of varying the slag composition so as to approach the 2Ca).$SiO_2$-periclase phase boundary.

9. A method as claimed in claim 8 comprising the step of maintaining a constant CaO:$Al_2O_3$ mas ratio.

10. A method as claimed in claim 8 comprising the step of adding no MgO or MgO containing material during the reduction.

11. A method as claimed in claim 1 comprising the step of effecting direct heating of the surface of the slag by means of a plasma or a DC-arc.

12. A method as claimed in claim 11 comprising the step of pre-heating feed material added to the slag in the arc or plasma.

13. A method as claimed in claim 11 wherein the direct heating is effected by a plasma torch and wherein the return electrode comprises metal.

14. A method as claimed in claim 1 wherein the reduction is effected at atmospheric pressure.

15. A method of producing magnesium by the metallothermic reduction of MgO comprising the steps of:

effecting the reaction in a molten slag bath comprising MgO, $al_2O_3$ and CaO together with oxide formed from the reducing metal, the slag defining a surface and a phase diagram having a periclase region as shown in FIGS. 1–6, adding reducing metal and MgO and MgO containing feed material to the bath, directly heating the surface of the molten slag, controlling the composition of the molten slag so that the composition is wholly within the periclase region of the phase diagram with a substantially constant liquidus temperature at least in the surface region, and maintaining at least the surface region of the slag by the direct heating at a temperature substantially equal to the liquidus temperature.

* * * * *